US007090201B2

(12) United States Patent
Brucker

(10) Patent No.: US 7,090,201 B2
(45) Date of Patent: Aug. 15, 2006

(54) MODULAR VINYL FENCING SYSTEM

(75) Inventor: John J. Brucker, Rumford, RI (US)

(73) Assignee: Simplicity Products, LLC, Providence, RI (US)

( * ) Notice: Subject to any disclaimer, the term of this patent is extended or adjusted under 35 U.S.C. 154(b) by 66 days.

(21) Appl. No.: 10/687,182

(22) Filed: Oct. 16, 2003

(65) Prior Publication Data

US 2004/0079935 A1 Apr. 29, 2004

Related U.S. Application Data

(60) Provisional application No. 60/419,502, filed on Oct. 18, 2002.

(51) Int. Cl.
*E04H 17/16* (2006.01)

(52) U.S. Cl. ..... 256/24; 256/19; 256/25; 256/65.02; 256/65.03; 256/65.08; 256/70

(58) Field of Classification Search ..... 256/19, 256/24, 25, 59, 65.01, 65.02, 65.03, 68, 65.08, 256/70, 65.16; 160/392, 395; 403/176
See application file for complete search history.

(56) References Cited

U.S. PATENT DOCUMENTS 3,037,593 A * 6/1962 Webster ..... 52/476
4,261,144 A * 4/1981 Rizzo ..... 52/63
4,540,160 A * 9/1985 Zanavich et al. ..... 256/19
4,794,744 A * 1/1989 Young et al. ..... 256/24
5,702,090 A * 12/1997 Edgman ..... 256/19
5,758,868 A * 6/1998 Shea ..... 256/12.5
6,413,004 B1 * 7/2002 Lin ..... 403/176
6,779,781 B1 * 8/2004 Bebendorf ..... 256/19

* cited by examiner

*Primary Examiner*—Daniel P. Stodola
*Assistant Examiner*—Michael P. Ferguson
(74) *Attorney, Agent, or Firm*—Barlow, Josephs & Holmes, Ltd.

(57) ABSTRACT

A fencing system is provided that is constructed from durable polymer components that are sufficiently rigid and durable while providing an integrated modular assembly that is easy to assembly and well suited to a do-it-yourself marketplace. In particular, the modular fence is an integrated system of interfitting vinyl components and a unique polycarbonate or ABS clip for interconnection thereof. The fence includes vertical posts with horizontal members extending therebetween. The horizontal members include grooves therein to support fence panels in the form of web panels. The horizontal members are connected to the vertical members utilizing a novel and uniquely configured connector element.

11 Claims, 8 Drawing Sheets

MODULAR VINYL FENCING SYSTEM

CROSS-REFERENCE TO RELATED APPLICATIONS

This application is related to and claims priority from earlier filed provisional patent application No. 60/419,502, filed Oct. 18, 2002.

BACKGROUND OF THE INVENTION

The present invention relates generally to a system and method for creating fencing systems. More specifically, the this invention relates to a new modular configuration that is particularly suited for fabricating and assembling vinyl fencing systems that are easier to install and are tailored to the do-it-yourself marketplace.

In the prior art, the vertical post members and the horizontal rail supports used in constructing fences have typically been made of wood. However, the traditional wood construction has become less desirable for several reasons. A primary drawback is that the overall cost of installing and maintaining a wooden fence system is relatively high due to the escalation in the cost of lumber materials in recent years and the fact that wood fences require constant maintenance such as painting or staining and prevention of rot. This is particularly true when wooden posts supporting a fence are anchored in the ground. If the posts fail due to rot, the entire fence is rendered useless. Although anchoring the posts in concrete can postpone these effects, it does not eliminate them. In addressing the preservation of the wood materials, the industry has created a secondary drawback related to the use of highly toxic preservatives to prevent the wood from rotting.

Further, fences have historically been designed and erected as permanent structures, without providing for subsequent removal or alteration. These permanent structures are been built on-site from the desired fencing materials, such as chain link or raw lumber, yielding integrated structures that cannot be easily dismantled without damaging the materials. The result is that most of these prior art fences that are constructed "on site" as unitary structures, are highly labor intensive and quite expensive to have initially installed. Additionally, wood fences constructed in this manner from raw lumber can also be non-uniform in appearance, detracting from their aesthetic qualities. This problem is further amplified when the installation process is attempted by a do-it-yourself installer who has relatively little experience in working with traditional fencing systems.

As an alternative to the wood fencing systems, fences having plastic horizontal rails that snap into vertical plastic posts are known. Typically, these plastic rails have snap-in connections formed on their ends and they "snap-in" directly to the plastic posts. Problems typically encountered with this type of plastic fence construction include the fact that these constructions do not take into account the expansion and contraction of the plastic and also that the support rails may tend to rotate in response to varying thermal conditions. Further, some of these plastic fences are made of a material that has sufficient plasticity to result in sagging rails and bending posts over time.

There is therefore a need to provide an esthetically pleasing fence that overcomes the above noted drawbacks associated with wood fencing systems. Further there is a need for a fencing system that is relatively inexpensive and durable, yet can be dismantled and reassembled in sections by a do-it-yourself consumer, if desired.

BRIEF SUMMARY OF THE INVENTION

In this regard, the present invention provides for a new fencing system constructed from durable polymer components that is sufficiently rigid and durable while providing an integrated modular assembly that is easy to assembly and well suited to a do-it-yourself marketplace. In particular, the present invention provides an integrated system of interfitting vinyl components and a unique polycarbonate or ABS clip for interconnection thereof.

The present invention includes vertical post elements, top and bottom horizontal rail elements, a novel connector clip and a webbing panel that is retained therein. The vertical posts are extruded material and may be of any suitable profile for fencing posts. At least two openings are provided in the sidewall of the vertical posts. Retention clips are inserted in to each of the openings in the vertical posts. When the clips are inserted into the openings in the posts, a portion of the clips momentarily deflect and then return to their undeflected state to engage the wall of the vertical tube. Due to the shape of the clips and the manner in which they engage the wall of the vertical tube, the clips resist being withdrawn from the vertical tubes and resist deflection or rotation.

The top and bottom horizontal rails each have openings in the ends thereof, allowing these members to slide over the retention clips. Small detent openings are provided in the sidewall of these tubes that engage a mating configuration on the retention clips when the rails are snapped into place. In this manner, the top and bottom rails are also firmly retained forming a unitary structure between the vertical fence posts and the top and bottom rails. The top and bottom rails also include a continuous longitudinal groove therein for receiving fencing panels.

The present invention also anticipates the possibility of employing intermediate rail members. In this manner the intermediate rails would have longitudinal grooves provided in both their top and bottom sides for receiving the top edge of one panel and the bottom edge of another thereby allowing two or more different panels to be employed in the same section of fence.

Accordingly, one of the objects of the present invention is the provision of an integrated modular vinyl fencing system. Another object of the present invention is the provision of a durable vinyl fence system that exhibits improved structural characteristics as compared to the prior art. Yet another object of the present invention is the provision of a vinyl fencing system that is constructed of modular components that can be made to be easily interchangeable and reconfigurable. A further object of the present invention is the provision of a modular vinyl fence system that includes standardized construction components that is further capable of being easily disassembled and reused in alternate configurations.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DETAILED DESCRIPTION OF THE INVENTION

Figure 1:
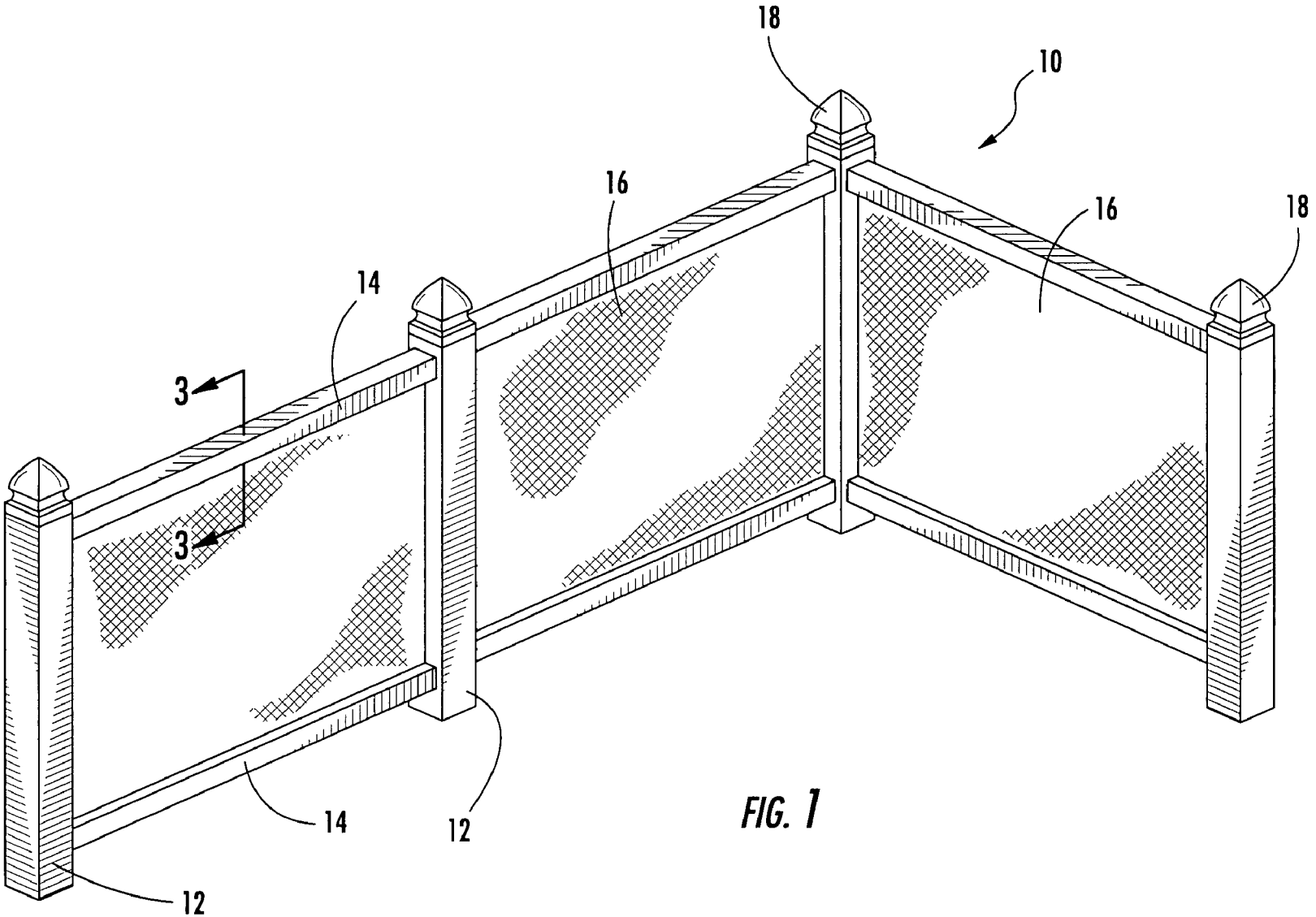
FIG. 1 is a perspective view of the assembled fence system of the present invention.

Referring now to the drawings, the fencing system of the present invention is illustrated and generally indicated at 10 in FIGS. 1–6. Further, an alternate embodiment of the present invention is illustrated and generally indicated at 100 in FIG. 7. As will hereinafter be more fully described, the fencing system 10 is assembled in sections wherein each section includes at least two vertical support posts 12 with at least two horizontal rails 14 extending therebetween. Each section of the fence system 10 may also include a fencing panel 16 supported between the horizontal rails 14 and caps 18 installed onto the vertical supports 12. The present invention therefore provides a convenient and economical modular fencing system 10 that is easily assembled and installed making the system convenient for both permanent and temporary fence installations that has not been previously available in the prior art.

Turning now to FIG. 1, several adjacent sections of the fencing system 10 of the present invention are shown fully assembled. The fencing system 10 is configured to be a modular system that is equally effective when installed as a single section, two linear adjacent sections or any conceivable arrangement of any number of interconnected sections. The adjacent sections of fencing may be disposed linearly, at 90° to one another, in a "T" configuration or at any relative angle require in a particular installation. For the purposes of the detailed description the interrelationship of the various components will be described in the context of a single fencing section although the concepts and principals of this disclosure can be extrapolated to any of the configurations described above with equal success.

As stated above, the fencing system 10 includes vertical supports 12 or fence posts. The vertical supports 12 in the present invention are tubular shaped members. While in the preferred embodiment the tubular members are shown to have a square cross-sectional profile, the tubes could be formed in any desired cross-section including but not limited to rectangular, circular, elliptical, hexagonal, octagonal and combinations thereof. The vertical support members 12 are installed in a parallel spaced apart relation in the desired location where the fencing will be installed. The vertical supports 12 could be installed by directly burying a portion of the support 12 into the ground or could be installed into support member (not shown) that may or may not be fastened to the ground. By using a support member the reconfigurability and temporary installation of the fence system 10 of the present invention may be enhanced. It should be understood that the manner in which the vertical posts 12 are anchored to the environment where the fence system 10 is installed is not critical to the present invention. Additionally, if desired for aesthetic purposes or to prevent moisture from entering the vertical supports 12, caps 18 can be installed on the top of the vertical supports 12.

Figure 2:
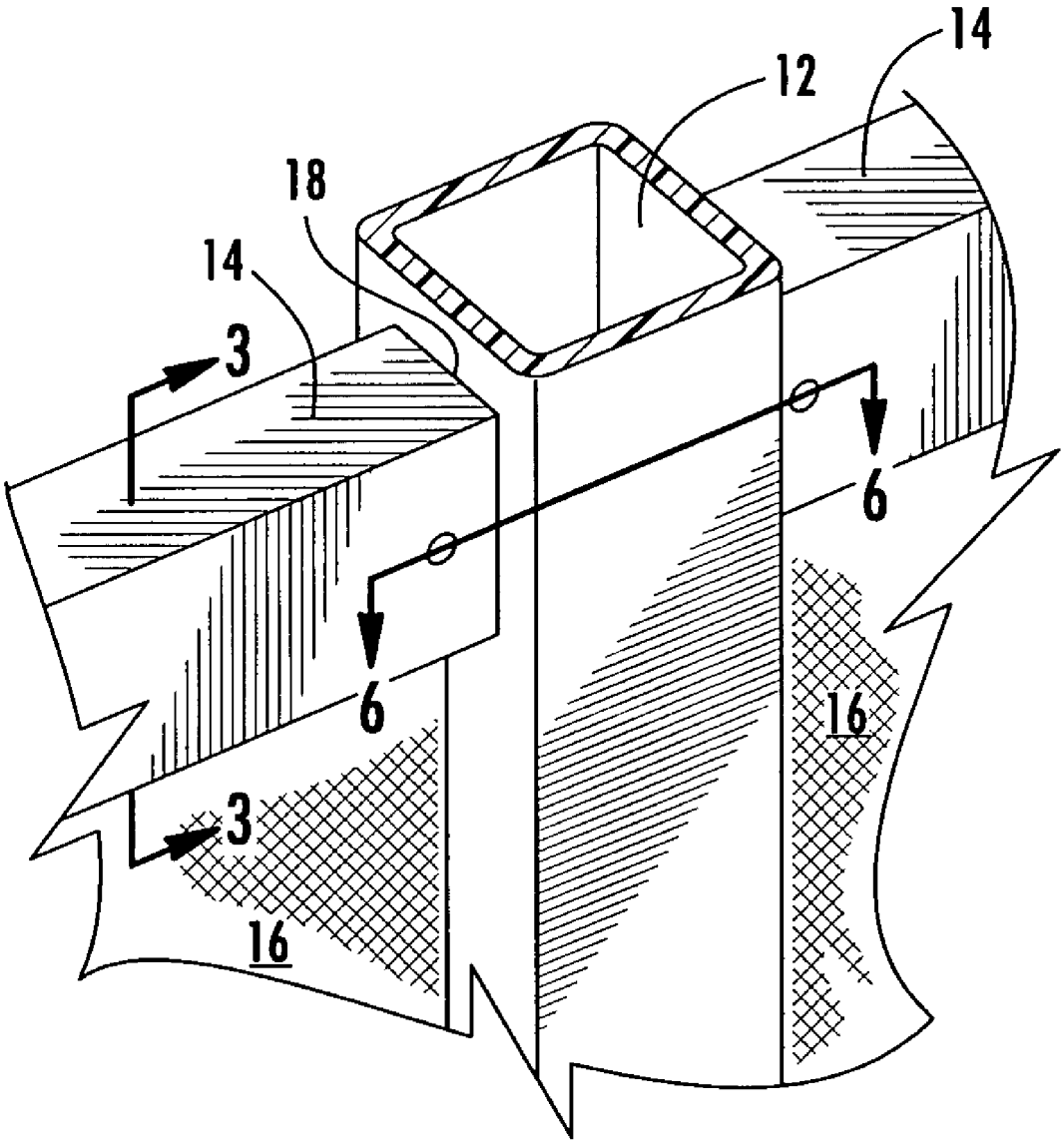
FIG. 2 is a detailed perspective view of the connection between the horizontal rail and the vertical support.

Turning now to FIG. 2, a detailed view of the connection between the horizontal rails 14 and the vertical supports 12 is shown. The ends 18 of the horizontal rail 14 contact the outer face of two of the vertical posts 12 and the horizontal rails 14 are retained and supported therebetween. Preferably, the present invention includes at least two horizontal rails 14 extending between each pair of vertical supports 12. It should be appreciated that when the present invention is assembled in configurations of multiple adjacent sections, each section does not require two distinct and separate vertical supports 12 as the second support for a preceding section serves also as a first support for a following section. The horizontal rails 14 are supported by rail connectors 20 as will be more fully described below. As can best be seen in FIG. 3, the horizontal rails 14 are also tubular sections. While the cross-sectional profile is shown as being square, as stated above any suitable or desirable profile may be used for the horizontal rails 14.

Figure 3:
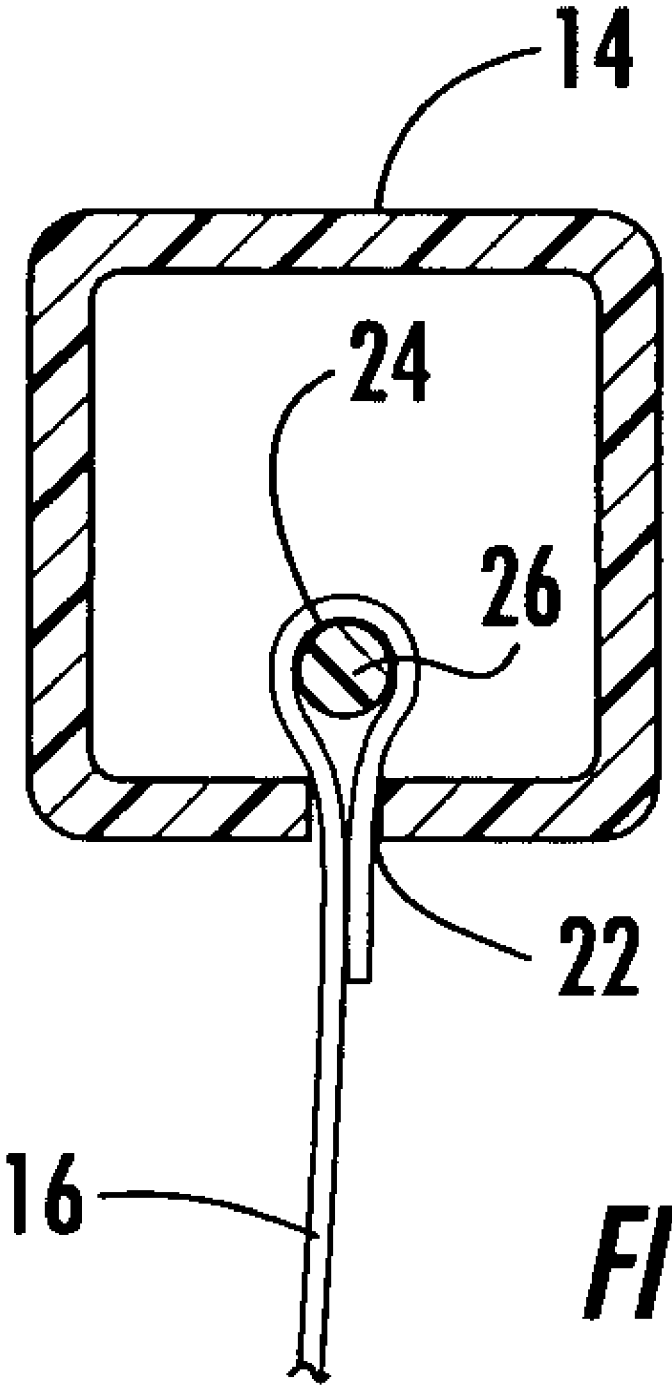
FIG. 3 is a cross-sectional view thereof taken along line 3—3 of FIG. 2.
Figure 3A:
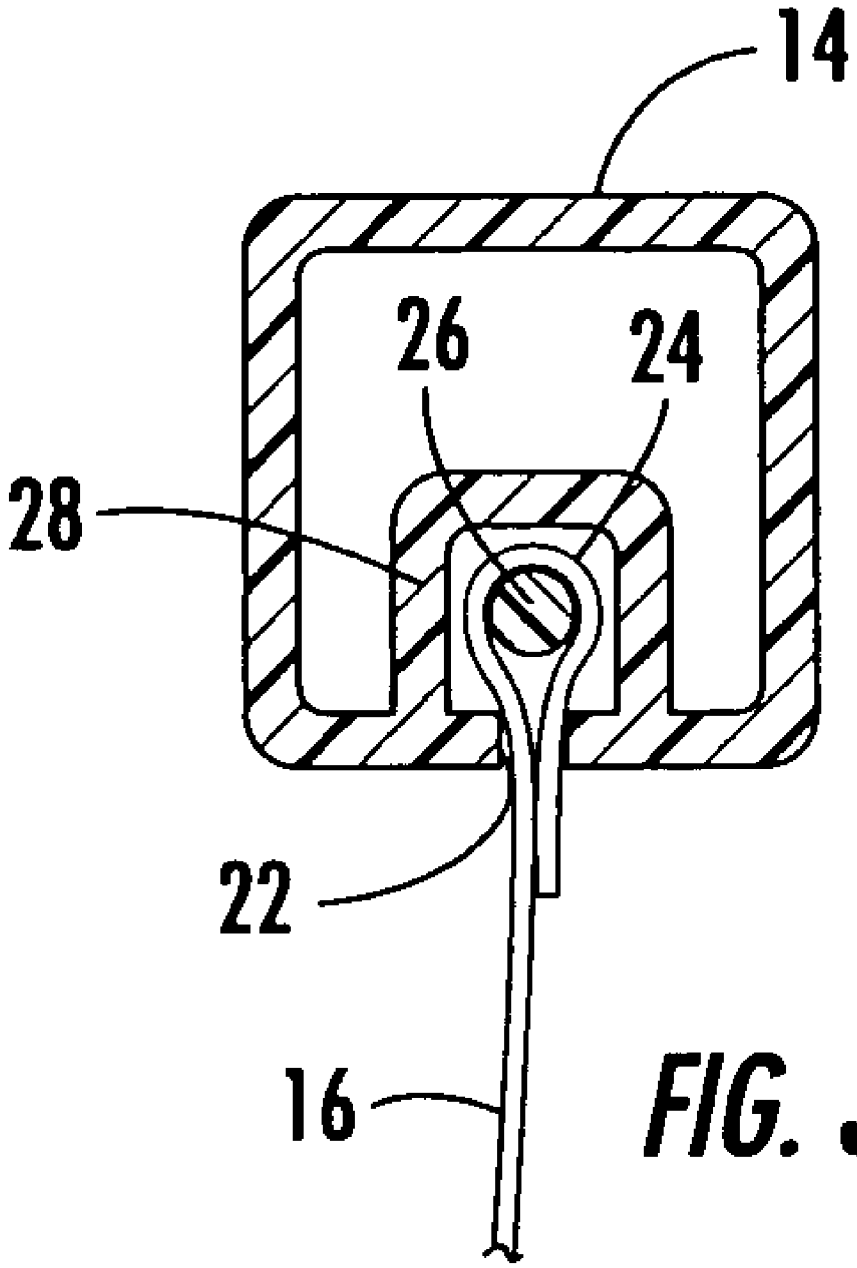
FIG. 3*a* is an alternative cross-sectional view thereof taken along line 3—3 of FIG. 2.

It can be further seen in FIG. 3 that the horizontal rails 14 include linear grooves 22 therein to receive a fencing panel 16 should one be desired in the particular fencing application. The fencing panel 16 is a flexible sheet of fabric material having pockets 24 extending along the top and bottom edges thereof. The pockets 24 have a retention member 26 placed therein to increase the overall thickness of the pocket 24 along the top and bottom edges. The retention tube 26 may be a dowel, a fiberglass rod, a piece of polymer tubing or any other suitable material for this application. To install the panel 16 into the system, the top pocket 24 including the installed retention member 26 is slid into the groove 22 in the top horizontal member 14 and the bottom pocket 24 is similarly slid into the groove 22 in the bottom horizontal rail 14 and the top and bottom rails 14 are installed between the vertical supports 12. In this manner the panel 16 is held in a taughtly stretched manner creating a fully closed fencing section. Optionally, as illustrated in FIG. 3*a*, the horizontal rail 14 may include a reinforcing wall 28 extending on its interior to maintain the dimensional stability of the cross section of the horizontal rail 14 and prevent the groove 22 from opening and releasing the panel 16 when under load. Further, in place of a continuous pocket 24 along the edge of the panels 16, a plurality of tabs that each include retention members could extend from the top and bottom edges thereof and be retained within the groove 22 in the horizontal rails 14.

The fencing panel 16 may be formed from a woven or knit fabric in any desired pattern of color. While the preferred material is polymer based, any other material such as canvas, laminated sheet goods or coated canvas could also be used and fall within the scope of the invention. Further the panel 16 may be formed using interwoven polymer webbing strips to form a basket weave pattern. As can be appreciated the above disclosure related to the general pattern and configuration of the panels 16 is meant to be illustrative and not limiting in any manner.

Figure 4:
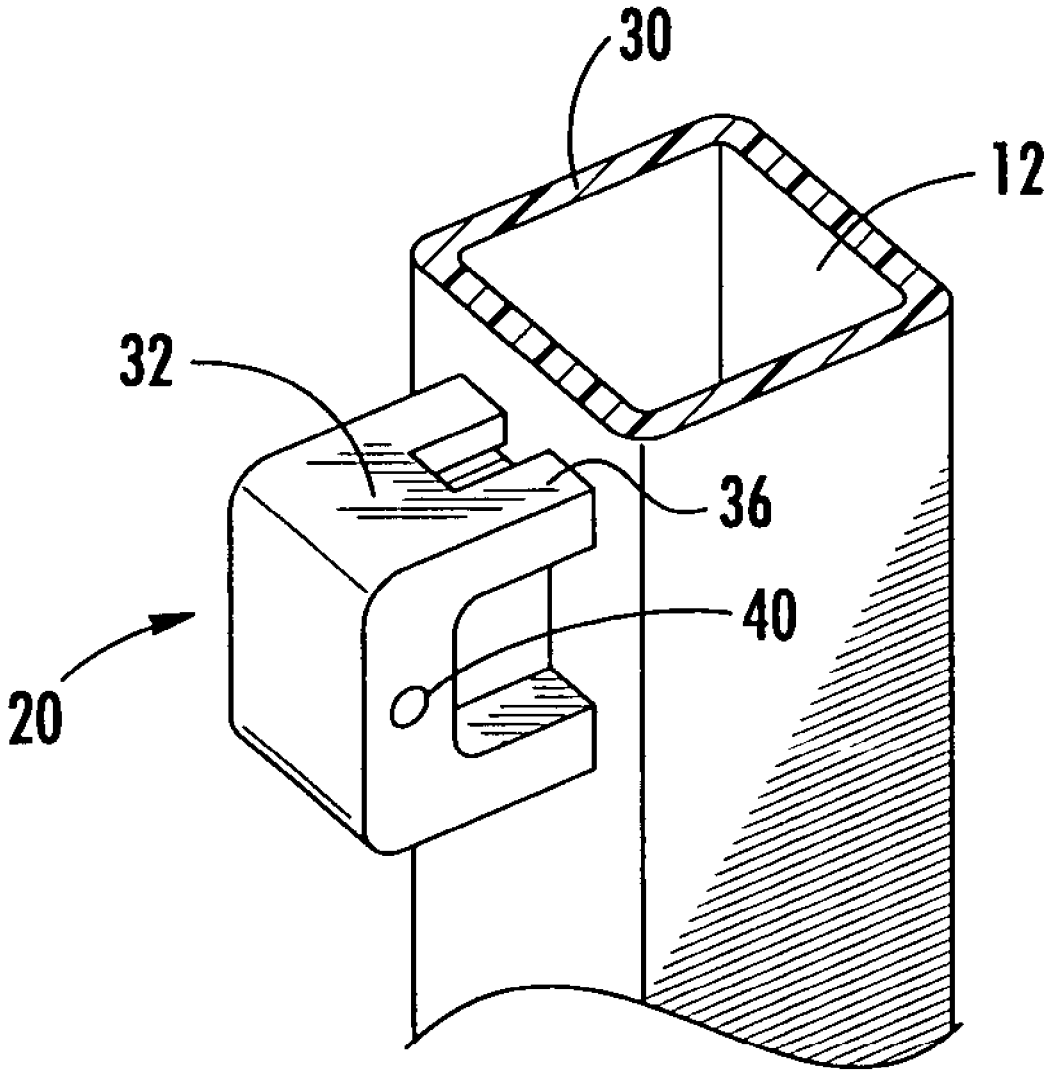
FIG. 4 is a perspective view of the rail connector mounted to the vertical support with the horizontal rail removed.
Figure 5:
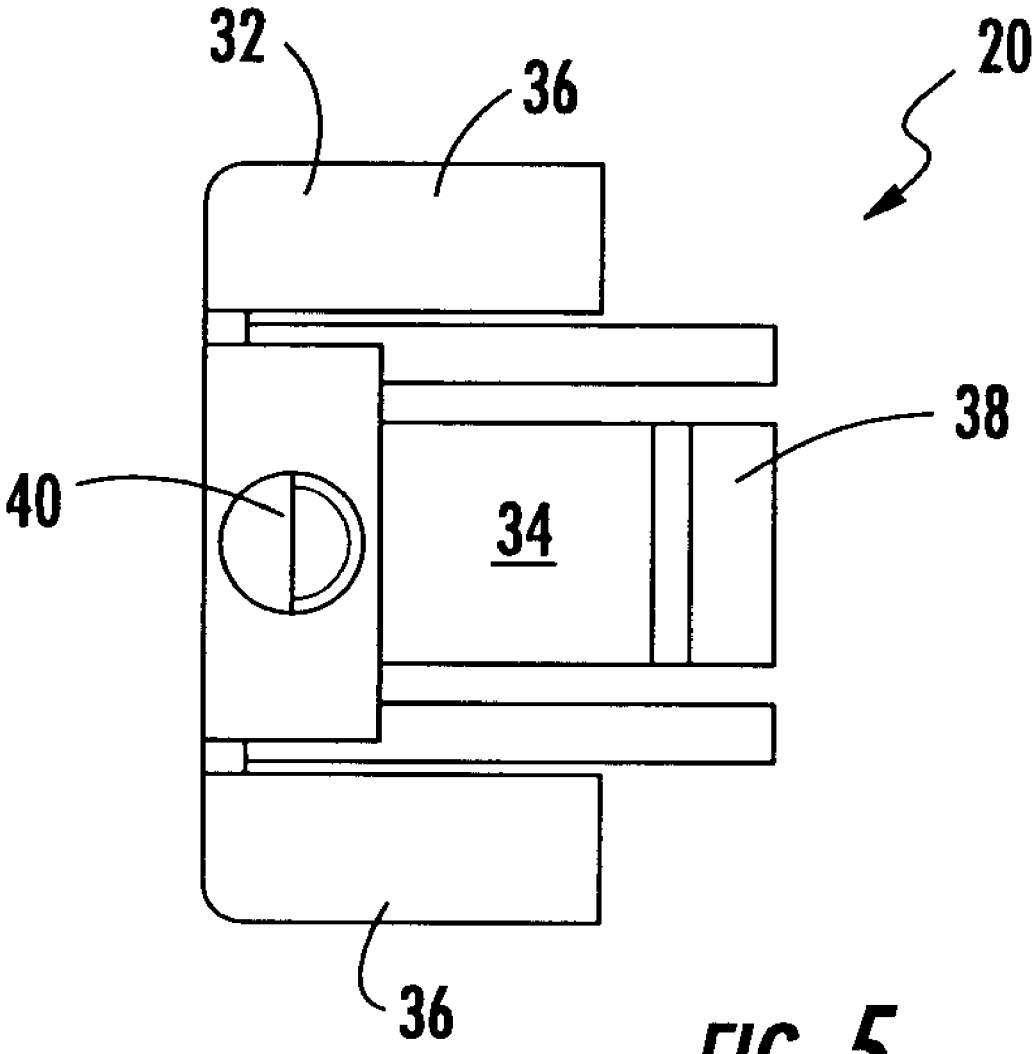
FIG. 5 is a side elevational view of the connector element of the present invention.
Figure 6:
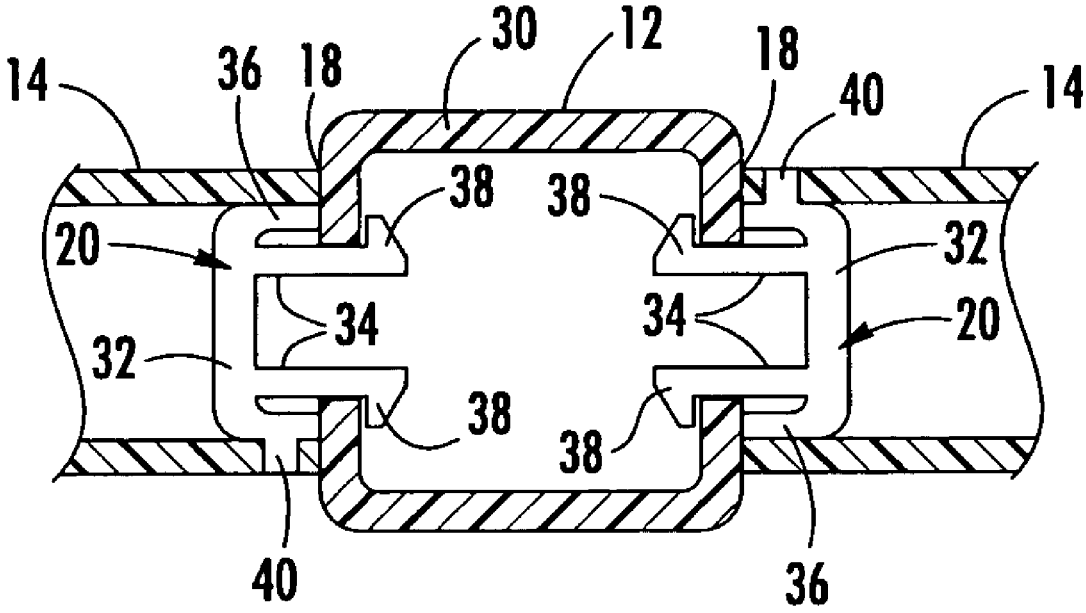
FIG. 6 is a cross-sectional view of the connector element installed in the vertical support as taken along line 6—6 of FIG. 2.

Turning now to FIGS. 4, 5 and 6 details of the rail connector 20 are shown. The rail connector 20 is installed into holes located in the sidewalls 30 of the vertical supports 12. The rail connector 20 includes a retention member 32 that extends outwardly from the vertical support 12 when the rail connector 20 is in assembled relation with the vertical post 12. The retention member 32 is configured to frictionally receive and retain the ends 18 of the horizontal rails 14. As can be seen the tubular configuration of the horizontal rails 14 provide openings in the ends 18 thereof that are received onto the retention member 32 of the rail connector 20. The rail connector 20 includes retention clips 34 that extend from the back of the retention member 32. When the rail connector 20 is installed onto the vertical post 12, the retention clips 34 extend into the hole in the wall 30 of the vertical support 12 and engage the wall 30 to securely hold the rail connector 20 in assembled relation with the vertical support 12. As can best be seen in FIG. 6, the rail connector 20 includes shoulders 36 that contact the outer surface of the vertical supports 12 and cooperate with the retention clips 34 to engage the wall 30 of the vertical support 12. The retention clips 34 are spring biased allowing them to deflect as the rail connector 20 is inserted into the hole in the vertical support 12 and return to their original, undeflected state wherein the tabs 38 at the ends of the retention clips 34 engage the wall 30 of the vertical support 12. Additionally, the rail connector 20 may include a detent 40 on the side of the retention member 32. The purpose of the detent 40 is to engage a hole located in the side wall of the horizontal rail 14 to prevent it from becoming dislodged from the rail connector 20.

The materials utilized for the vertical posts 12, horizontal rails 14 and rail connectors 20 may be either metallic or polymer based. In the preferred embodiment of the preset invention, polymer materials are utilized to reduce the cost, make the parts easier to handle and provide longer term durability and a cleaner appearance. The vertical supports 12 and the horizontal rails 14 are preferably formed from extruded vinyl and PVC, although any other suitable polymer may be employed. Further the rail connector 20 is preferably formed from a polymer material such as ABS, PVC, HDPE or polycarbonate.

Figure 7:
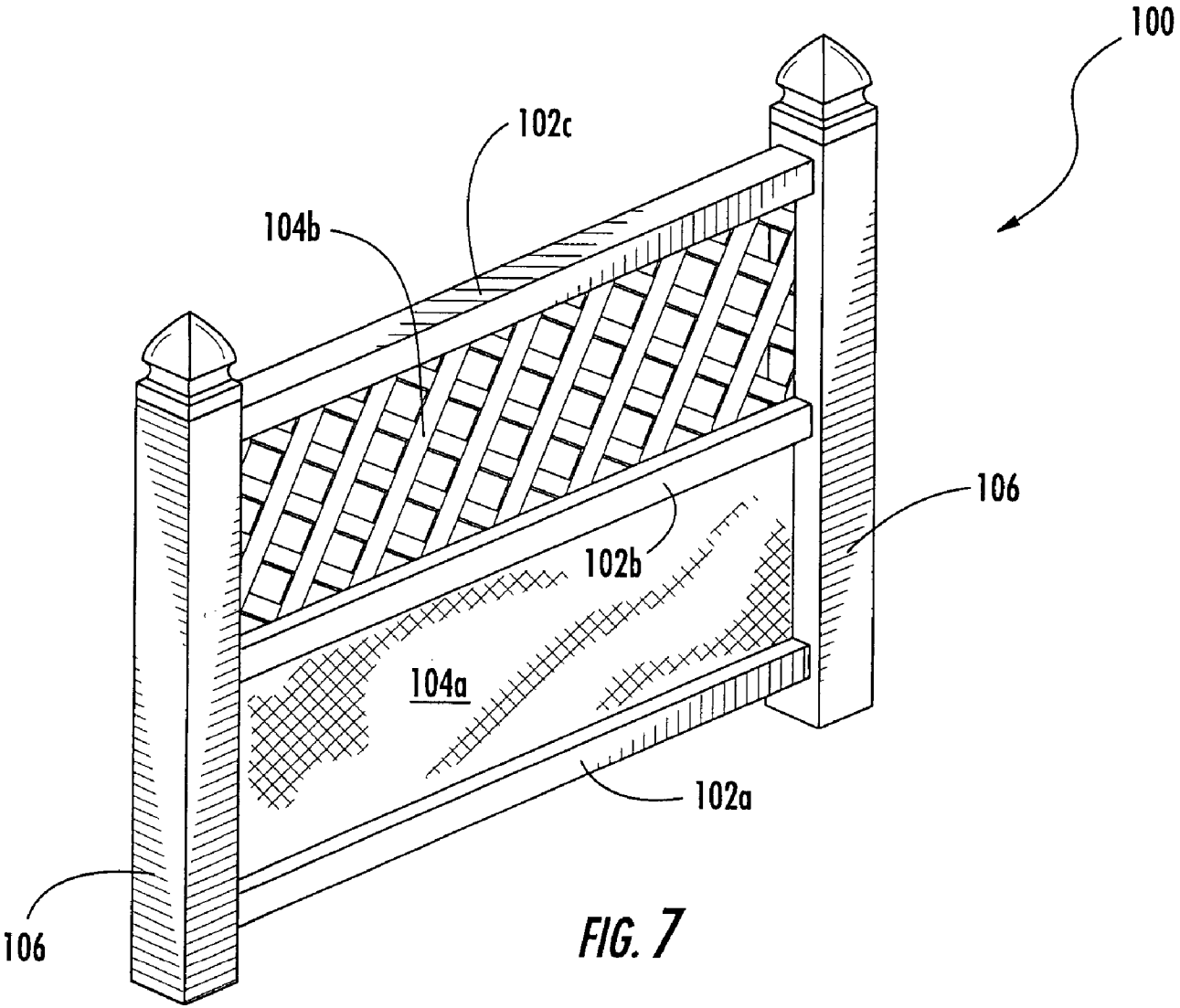
FIG. 7 is a perspective view of an alternate embodiment of the present invention.

Turning now to FIG. 7, an alternate embodiment 100 of the present invention is shown. This embodiment is intended to illustrate a configuration wherein three horizontal rails 102*a–c* are used in conjunction with two panels 104*a–b* to create a customized fence appearance. As described above, at least two vertical supports 106 are arranged is spaced parallel relationship. Three horizontal rails 102*a–c* are installed between the two vertical supports 106 utilizing rail connectors 20 as described above. While the top 102*c* and bottom 102*a* rails each include one longitudinal groove in the walls thereof, the middle rail 102*b* includes a groove in both its top and bottom surface. In this manner a top panel 104*b* can extend between the top rail 102*c* and the middle rail 102*b* and be retained in the groove in the top of the middle rail 102*b*. Further, a bottom panel 104*a* extends between the bottom rail 102*a* and the groove in the bottom of the middle rail 102*b*. In this manner, the installed fencing system 100 can have a custom appearance and can include two panels 104*a–b* having two different patterns, textures or appearances.

It can therefore be seen that the present invention provides a unique modular fencing system 10 that is inexpensive to fabricate yet is highly durable and requires little maintenance. The fencing system 10 is easy to install, reconfigure and remove as required and is well suited to a do-it yourself installer. Further, the present invention can be modified and reused as required to facilitate temporary installations. For these reasons, the instant invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A fence system comprising:

at least two spaced tubular vertical support members, each of said vertical support members having side walls and at least two vertically spaced holes in at least one side wall thereof;

rail connectors configured to be received and retained in each of said holes in said vertical support members, each of said connectors including:

a receiver end, said receiver end having shoulders that contact an outer surface of said side wall of said vertical support members and extends outwardly from said side wall of said support members when said connector is assembled therewith, an opposing pair of retention clips extending from a rear surface of said receiver end, said opposing pair of retention clips configured to extend into said hole in said sidewall of said vertical support member and cooperate to engage said sidewall to retain said rail connector in said assembled relation, and an opposing pair of guide pins extending from a rear surface of said receiver end, said opposing pair of guide pins contacting opposite sides of said hole, said opposing pair of guide pins configured and arranged to prevent said rail connector from rotating relative to said vertical support member;

at least two horizontal rails, each of said rails having a first end and a second end, each of said ends of said rails having openings therein, said openings configured to be frictionally received and retained by said receiver end of said rail connectors and a linear groove extending between said first and second ends of each of said horizontal rails; and a fence panel having a top and bottom edge, said fence panel extending between and supported by said spaced horizontal rails, wherein said top and bottom edges are received and retained in said grooves in said horizontal rails, wherein said at least two horizontal rails are supported in parallel spaced relation between said at least two vertical support members.

2. The fence system of claim 1, wherein said fence panel is a material selected from the group consisting of: woven polymer fabric, interwoven polymer strapping and knitted polymer fabric.

3. The fence system of claim 1, wherein said top and bottom edges of said fence panel include pockets extending along the length thereof, wherein a retention member is inserted into said pockets to prevent said edge of said panel from being removed from said grooves in said horizontal rails.

4. The fence system of claim 1, wherein said top and bottom edges of said fence panel include a plurality of spaced tabs extending outwardly therefrom into said grooves in said horizontal rails, said tabs including pockets, wherein a tubular member is inserted into said pockets to prevent said tabs from being removed from said grooves in said horizontal rails.

5. The fence system of claim 1, further comprising:

three vertically spaced holes in at least one side wall of each of said vertical supports; and three horizontal rails, each of said rails having a first end and a second end, each of said ends of said rails having openings therein, said openings configured to be frictionally received and retained by said receiver end of said rail connectors, wherein said at three horizontal rails are supported in parallel spaced relation one of said rails in a top position, one of said rails in a middle position and one of said rails in a bottom position between said at least two vertical support members.

6. The fence system of claim 5, further comprising:

a linear groove extending between said first and second ends of each of said top and bottom horizontal rails;

two linear grooves between said first and second ends of said middle rail;

a first fence panel having a top and bottom edge, said first fence panel extending between and supported by said top and middle spaced horizontal rails, wherein said top and bottom edges are received and retained in said grooves in said top and middle horizontal rails; and a second fence panel having a top and bottom edge, said second fence panel extending between and supported by said middle and bottom spaced horizontal rails, wherein said top and bottom edges are received and retained in said grooves in said middle and bottom horizontal rails.

7. The fence system of claim 1, wherein said holes in said side wall of said vertical supports are rectangular shaped.

8. The fence system of claim 1, said rail connector further comprising:

a locking detent extending from a side of said receiver end, said detent configured and arranged to engage a retention hole in the side of said horizontal rail when said end of said rail is in assembled relation with said rail connector.

9. The fence system of claim 1, wherein said vertical supports, said rail connectors and said horizontal rails are metallic.

10. The fence system of claim 1, wherein said vertical supports and said horizontal rails are formed from a material selected from the group consisting of extruded vinyl and PVC.

11. The fence system of claim 1, wherein said rail connector is formed from a polymer material selected from the group consisting of ABS, PVC, HODE and polycarbonate.

* * * * *